United States Patent [19]

Theurer

[11] 3,968,752

[45] July 13, 1976

[54] MOBILE TRACK WORKING MACHINE

[75] Inventor: Josef Theurer, Vienna, Austria

[73] Assignee: Franz Plasser Bahnbaumaschinen-Industriegesellschaft m.b.H., Vienna, Austria

[22] Filed: Feb. 18, 1975

[21] Appl. No.: 550,751

[30] Foreign Application Priority Data

Sept. 27, 1974 Austria ..... 7794/74

[52] U.S. Cl. ..... 104/7 B; 33/287; 104/12; 254/43

[51] Int. Cl.[2] ..... E01B 27/17; E01B 29/04

[58] Field of Search ..... 104/7 R, 7 A, 7 B, 8, 104/12, 2; 254/43, 44; 33/287, 144, 146

[56] References Cited

UNITED STATES PATENTS

| | | | |
|---|---|---|---|
| 2,966,123 | 12/1960 | Talboys | 104/8 |
| 3,417,708 | 12/1968 | Sauterel | 104/8 |
| 3,444,822 | 5/1969 | Oville et al. | 104/8 |
| 3,503,132 | 3/1970 | Fisher | 104/8 X |
| 3,556,010 | 1/1971 | Plasser et al. | 104/7 R |
| 3,568,604 | 3/1971 | Sauterel | 104/8 |
| 3,685,157 | 8/1972 | Plasser et al. | 104/7 R X |
| 3,832,952 | 9/1974 | Hurni | 104/7 B |

*Primary Examiner*—Robert J. Spar
*Assistant Examiner*—Randolph A. Reese
*Attorney, Agent, or Firm*—Kurt Kelman

[57] ABSTRACT

In a mobile track working machine, which comprises a track lining and leveling unit which may be moved transversely and vertically to the track for lining and leveling the track, flanged lining rollers mounted on the unit for engagement with an associated rail, and power-actuated rail lifting hooks mounted on the unit, the improvement of drives for continuously and simultaneously moving the lining rollers into substantially play-free engagement with the associated rails, and a control for the drives for temporarily holding the lining rollers in a fixed relation to the unit.

12 Claims, 5 Drawing Figures

MOBILE TRACK WORKING MACHINE

Figure 1:
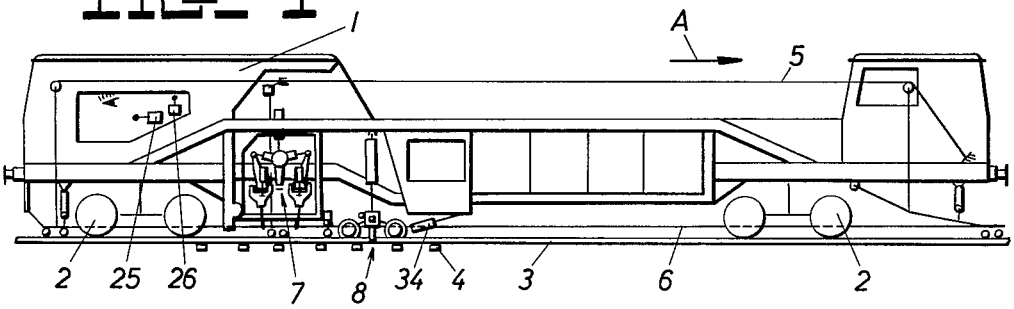

The present invention relates to improvements in mobile apparatus for working on a track including tow rails fastened to ties, which comprises a track lining and leveling unit having a frame mounted for mobility on the track rails, hydraulic drive means for moving the frame in mutually perpendicular directions extending transversely and vertically to the track for lining and leveling the track, flanged lining rollers mounted on the frame for engagement with an associated one of the rails, and power-actuated rail lifting hooks mounted on the frame and arranged to subtend the rail.

U.S. Pat. No. 3,871,299, dated Mar. 18, 1975 discloses a mobile apparatus for correcting the track gage simultaneously with the lining and leveling of a track. In this apparatus, a combined leveling and lining unit is associated with each rail and the two units are interconnected by two adjustment drives extending transversely to the track to change the spacing between the two units. In view of the constantly changing track gage, the lining rollers are not always in play-free engagement with the associated rails.

In U.S. Pat. No. 3,392,678, granted July 16, 1968, apparatus has been proposed for correcting track at switches, crossings and the like, wherein rail lifting units are associated with tamping units movable transversely to the track for common movement therewith, with the lifting units comprising rail hooks or clamps subtending the rails for engagement therewith. Here, too, it is not always possible to engage the rail clamps play-free with the rails.

Track working machines with combined rail lifting and lining units have also been proposed wherein the rail lifting and lining tools are mounted on a common frame. In these known units, the lining rollers are mounted in fixed relation to the frame. When such machines are used in the intermittent lining of track, wherein the machine is advanced from tie to tie for successive lining operations at each tie, the frequently occurring play between the lining rollers and the associated rails sometimes results in a sudden impact on the rail fastening elements at the beginning of the lining operation, as the lining roller is moved into contact with the rail. This often causes loosening of the fastening elements.

While the known machines have proved to be quite effective in track correction operations, the ever increasing demands made on tracks by increasing train speeds and loads make it necessary to avoid undue pressures, with possible loosening as a result thereof, on the rail fastening elements during lining operations.

It is the primary object of the present invention to provide a track working machine of the described type, wherein the track lining and leveling unit is so controlled as to avoid possible damage to the rail fastening elements while assuring a safe and effective track correction operation.

This and other objects are accomplished in such a machine in accordance with this invention by adjustment drive means for continuously and simultaneously moving the lining rollers into substantially play-free engagement with the associated rails, and a control for the adjustment drive means for temporarily holding the lining rollers in a fixed relation to the frame of the track lining and leveling unit.

This arrangement enables work on the track to be done with outstanding sensitivity and readily to adapt the spacing of the lining rollers associated with the respective track rails to changing track gages as the track working machine advances along the track. Furthermore, the accuracy of the track correction effectuated by means of the novel track lining and leveling unit is greatly increased.

Since the lining rollers of the unit are in constant play-free engagement with the track rails, sudden impacts on the track and track fastening elements are avoided, particularly at the onset of lining operations and even if the direction of lining is rapidly changed. This play-free engagement assures a continuous transmission of force from the machine frame and the lining unit to the track rails, which avoids undue stresses on the springs of the undercarriages, which may be caused by sudden impacts of force in a lateral direction transverse of the track elongation. The accuracy of the lining operation over a long stretch of track section is increased because actuation of the lining unit may be effected with a much higher accuracy. Furthermore, the control of the present invention in a simple manner assures that the track gage is not changed during the leveling and lining operation since the lining rollers associated with the two rails are locked in position during this operation and thus permit no changes in the spacing of the rails. At the same time, if the spacing of the rollers is pre-set to a given gage before they are locked in position, the track gage may be accordingly corrected when the lifting hooks are engaged with the rails, for instance in cases where the rail fastening elements are loose. Finally, the same advantages are obtained if the arrangement of this invention is used only for lining.

Figure 4:
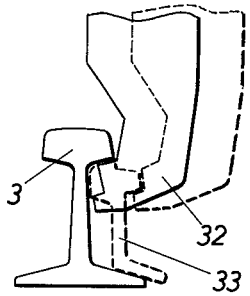
Figure 2:
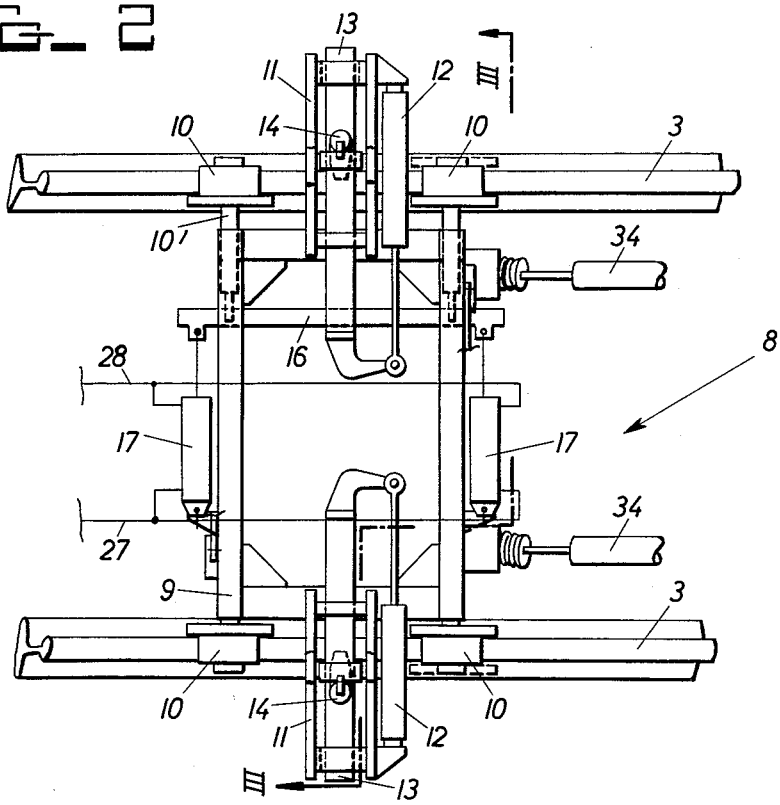
Figure 2A:
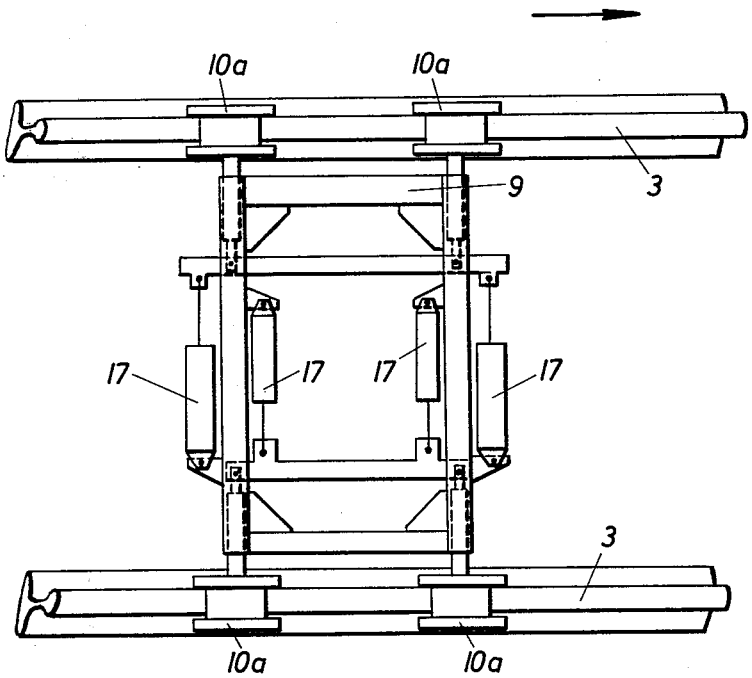
Figure 3:
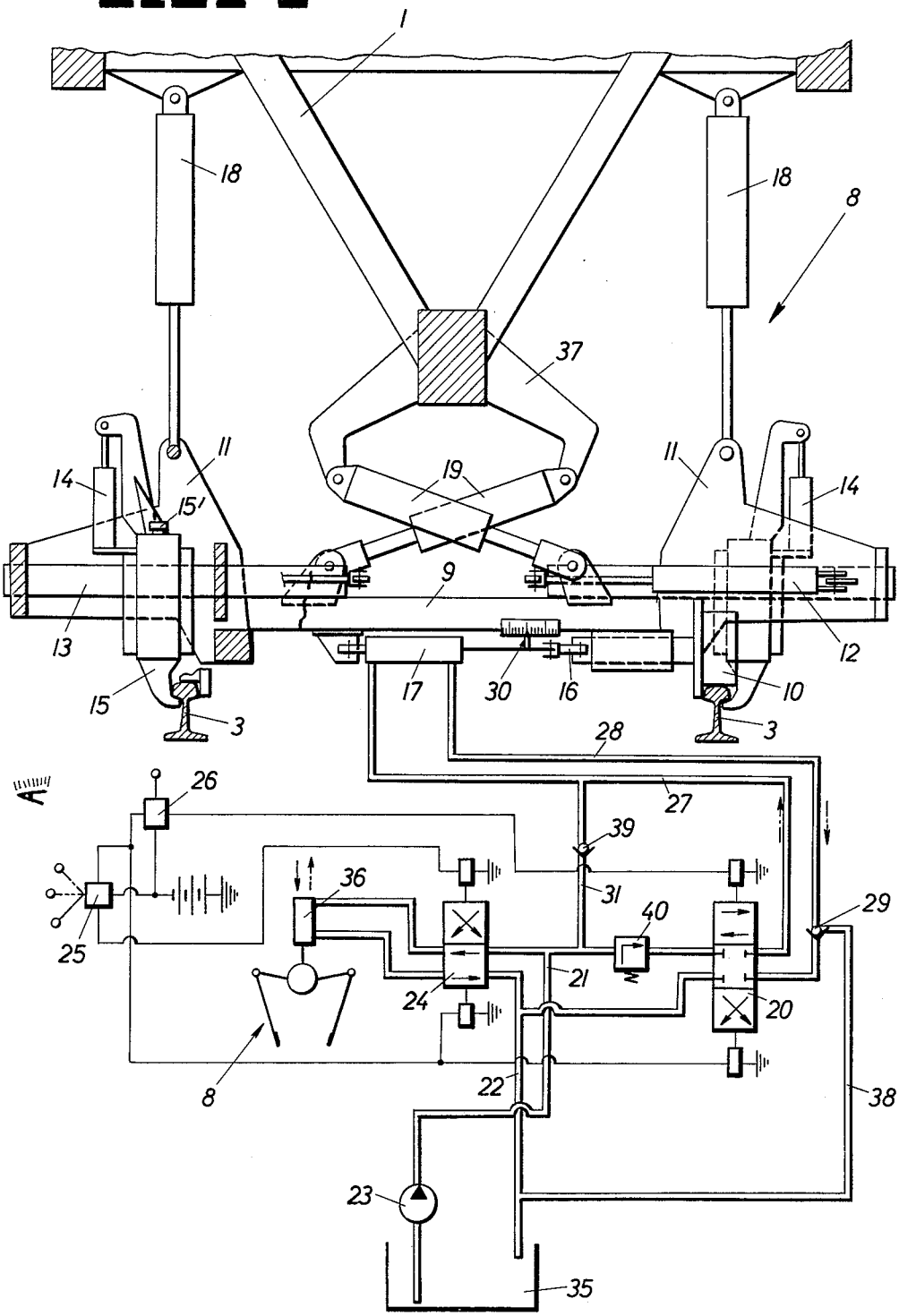

The above and other objects, advantages and features of the present invention will become more apparent from the following detailed description of certain now preferred embodiments thereof, taken in conjunction with the accompanying drawing wherein FIG. 1 is a schematic overall side view of a mobile tamping machine for lining and leveling track incorporating this invention;

FIG. 2 is an enlarged plan view of an embodiment of the lining and leveling unit according to the invention;

FIG. 2*a* is a view similar to that of FIG. 2 but showing only the lining roller arrangement of a modified embodiment;

FIG. 3 is a side elevational view, partly in section, along lines III—III of FIG. 2 and includes a purely schematic circuit diagram for the control according to the invention; and FIG. 4 is a side elevational view of a modified embodiment of a rail lifting hook.

Referring now to the drawing and first to FIG. 1, a generally conventional mobile track lining, leveling and tamping machine is shown to comprise frame 1 mounted on undercarriages 2, 2 for mobility on a track which includes two rails 3, 3 fastened to ties 4. The machine frame is quite long and carries a conventional leveling reference system 5 and lining reference system 6 to control the grading and lining of the track in a manner well known and forming no part of the present invention. In such conventional lining reference systems, the measuring bogies are pressed play-free against the grade rail to avoid track correction inaccuracies.

During track maintenance operations, the machine moves along the track in the direction of arrow A. Tamping unit 7 is mounted on machine frame 1 adjacent rear undercarriage 2 (as seen in the operating direction of the machine) for tamping ballast underneath track ties 4. Immediately frontward of the tamping unit (as seen in the operating direction) there is mounted track lifting and lining unit 8. All of the arrangements so far described are generally conventional.

The present invention is concerned with the specific structure of unit 8 which is illustrated in FIGS. 2, 2*a* and 3, a preferred embodiment of a rail lifting hook for use in such a unit being shown in FIG. 4. The illustrated lining and leveling unit comprises frame 9. Two flanged lining rollers 10 are associated with each rail 3 and are mounted on frame 9 for engagement with the rails, the two rollers being spaced from each other in the direction of track elongation, the spacing between the two rollers being preferably substantially the same as that between adjacent ties 4. The rollers 10 serve also to guide frame 9 along the track rails so that the frame is mounted for mobility on the track rails. Brackets 11 are affixed to frame 9, for instance by welding, intermediate the two rollers 10, 10 associated with each rail 3 and a guide rod 13 is mounted in each bracket 11 for movement in a direction extending transversely to the track. In the illustrated embodiment, guide rods 13 are of polygonal, for instance quadratic, cross section and are guided in bracket guides of like cross section to avoid rotation of the guide rods during their transverse movement. Suitable drives are provided for actuating the transverse movement of the guide rods, the illustrated drives being hydraulic motors 12 whose cylinders are affixed to the brackets and whose piston rods are linked to the guide rods. As best shown in FIG. 3, rail lifting hooks 15 are mounted on guide rods 13 and are arranged to subtend the rail heads for engaging the rails during the leveling operation. Power-actuated drive means are provided for moving the lifting hooks in a direction extending vertically to the track, the illustrated power-actuated drive means being hydraulic motors 14 whose cylinders are affixed to the guide rods and whose piston rods are linked to the hooks.

Set screw 15′ is mounted on top of hook 15 to enable the distance between the upper end of the hook and guide rod 13 to be adjusted, which makes it possible to adapt the hook to different types of track configurations with different rail heights and/or rail head heights.

Hydraulic drive means are provided for moving frame 9 in mutually perpendicular directions extending transversely and vertically to the track to enable unit 8 to be mounted on the track at the beginning of a track correction operation and to be lifted off the track after completion thereof, as well as for lining and leveling the track during the operation. The illustrated drive means consist of hydraulic motors 18 and 19 whose cylinders are linked to machine frame 1 while the piston of hydraulic motor 18 is linked to bracket 11 and that of motor 19 to frame 9.

As shown in FIGS. 2 and 3, the two flanged lining rollers 10, 10 associated with one of the rails (the upper one in FIG. 2 and the right one in FIG. 3) are mounted for transverse movement in relation to frame 9 in a direction extending transversely of the track. For this purpose, stub axles 10′ of the rollers are journaled in crossbeam 16 which interconnects the two rollers and adjustment drive means for continuously and simultaneously moving the lining rollers into substantially play-free engagement with the associated rail are connected to the crossbeam. The illustrated adjustment drive means are pressure fluid-actuated and comprise a pair of hydraulic drives 17, 17 whose cylinders are mounted on frame 9 while their pistons are linked to the respective ends of crossbeam 16 spaced from each other in the direction of track elongation.

FIG. 3 purely schematically shows a simplified circuit diagram of a control for the adjustment drive means 17 for temporarily holding the lining rollers in a fixed relationship to frame 9 and thereby locking them in position, particularly usefully at the beginning of a lining operation.

The illustrated adjustment drive means is a double-acting piston-and-cylinder drive comprising a cylinder housing a piston dividing the cylinder into two chambers. Conduits 27 and 28 are respectively connected to the cylinder chambers for delivering and/or removing hydraulic fluid to and from the respective chambers under the control of valve 20 which controls the actuation of drive 17. The illustrated control valve is an electrically actuatable solenoid slide valve adjustable for selective connection of one of the conduits 27 and 28 to hydraulic fluid delivery line 21 and of the other conduit 27 or 28 to hydraulic fluid return line 22. A source of hydraulic fluid consisting of hydraulic oil sump or tank 35 holds a supply of the fluid, delivery line 21 leading from the tank and return line 22 leading thereto. Constant speed pump 23 delivers the hydraulic fluid to the delivery line. Electrical control switches 25 and 26 are mounted in the operator's cabin (see FIG. 1) to enable an operator to actuate the controls. In the illustrated embodiments, these include control valve 24 similar to that of valve 20 for controlling the lifting and lowering of tamping unit 7 in an otherwise known manner. The tamping unit control proper forms no part of the present invention.

The above-described hydraulic circuit has the advantage that the control valve very simply assures movement and locking of the piston of drive 17 in the desired manner while the lack of compressibility of the hydraulic liquid, which is interposed between the lining rollers and the frame, assures the fixed holding of the rollers in the adjusted position, i.e., prevents any play between the rollers and the associated rail.

The illustrated arrangement of two rollers associated with a rail and interconnected by a crossbeam connected to the adjustment drive means for the rollers has the advantage of providing a uniform engagement of the rail by the rollers and a uniform distribution of the lining forces. The lifting forces are symmetrically distributed by the illustrated mounting of the rail lifting hooks centrally between the two rollers associated with each rail.

The above-described apparatus operates in the following manner:

Pump 23 delivers hydraulic fluid from tank 35 into delivery line 21 which has branch lines leading respectively to solenoid slide valves 20 and 24, the specifically illustrated hydraulic circuit including pressure reducing valve 40 in the branch line leading to valve 20 since the pressure required for vertically moving tamping unit 7 is considerably greater than the pressure needed for adjustment of the lining rollers. In the illustrated position of the controls, i.e., when the machine has been stopped to start a correction operation, control switch 25 has been depressed into the position shown in full lines to adjust valve 24 so that hydraulic fluid will flow from line 21 through the valve into the upper cylinder chamber of hydraulic drive 36 for lowering unit 7, the lower cylinder chamber being simultaneously connected by valve 24 to return line 22. Thus, the tamping tools of the unit are immersed into the ballast.

The electric control circuit connecting switch 25 to solenoid valves 24 and 20 is so wired that valve 20 receives no current, i.e., remains in its position of rest, when valve 24 is actuated to lower the tamping tools into the ballast at the beginning of a tamping operation. In the illustrated rest position of valve 20, conduits 27 and 28 leading to the cylinder chambers of lining roller adjustment drives 17 are closed, thus preventing any flow of hydraulic pressure fluid into or out of the cylinder chambers. In other words, the lining rollers are locked in position at this stage of operation. Thus, as shown in FIG. 2, lining rollers 10 engage the heads of rails 3 without play as the tamping and track correction operation proceeds.

As shown in FIG. 3, frame 9 of the lining and leveling unit, which carries lining rollers 10 and rail lifting hooks 15, is movable in mutually perpendicular directions extending transversely and vertically to the track for lining and leveling the track when the rollers and hooks engage the track rails, the moving force exerted upon the frame being transferred to the rails without play and with maximum effect when the lining rollers engage the rails without play. The frame is lifted vertically and moved transversely by hydraulic drive means, the illustrated lifting means including hydraulic motors 18 whose cylinders are linked to machine frame 1 while their piston rods are linked to brackets 11 welded to frame 9. The illustrated lining means includes hydraulic motors 19 whose cylinders are linked to yoke 37 affixed to machine frame 1 and carrying the cylinders while their piston rods are linked to frame 9.

After the track has been corrected, i.e., leveled and/or lined, and fixed in the corrected position by tamping, the operator throws switch 25 into the position shown by a chain-dotted line. This causes actuation of slide valve 24 into a position wherein hydraulic fluid delivery line 21 is in communication with the lower cylinder chamber of motor 36 while the upper cylinder chamber is connected to return line 22. This causes the tamping unit 7 to be lifted so that the tamping tools are removed from the ballast. Simultaneously, slide valve 20 is actuated into a position wherein conduit 27 is in communication with hydraulic fluid delivery line 21 so that hydraulic fluid is delivered into the cylinder chamber of drive 17 which is remote from the associated lining roller 10 while conduit 28 is connected to return line 22 to permit hydraulic fluid to flow out of the cylinder chamber adjacent the associated lining roller. This will cause the lining roller to be pressed into play-free engagement with the rail head.

In the illustrated control, three-way valve 29 is mounted in conduit 28 so that the cylinder chamber adjacent the lining roller is in constant communication with hydraulic fluid sump 35 via branch line 38. This arrangement assures the continuous play-free engagement of the lining rollers with the rails and dependable, rapid locking of the lining rollers into positions determined by the respective track gage at all track points, the control valve arrangement always connecting one of the lining roller adjustment drive cylinder chambers with the hydraulic fluid delivery line while the other cylinder chamber is connected to the return line, the pressure cylinder chamber always being blocked during the lining operation.

While the machine advances in the operating direction to the next track correction point, motors 17 will continue to exert transverse pressure against cross-beam 16 to assure play-free engagement of lining rollers 10 with the associated rails. When the machine is stopped at the subsequent correction point, switch 25 is again thrown into the position shown in full lines so as to lock the lining rollers in their position during the ensuing correction operation described hereinabove.

Care must be taken that the actuation of slide valve 20 for locking the lining rollers in position is so timed in relation to the operation of lining motors 19 that the motors do not begin the lining movement of frame 9 before the lining rollers are locked in position, i.e., valve 20 prevents any flow of hydraulic fluid into or out of motor 17 before, or no later than, hydraulic fluid is delivered to motor 19. Thus, when the leveling and lifting unit frame is moved in relation to machine frame 1 to correct the track position, the lining rollers will always be locked in play-free engagement with the track rails, regardless of the track gage, to provide accurate and effective track correction. In continuous lining operation, in which the track is lined by a continuously advancing machine without intermittent stops at spaced track correction points, the lining rollers remain permanently locked in position for play-free engagement with the track rails. In this case, however, it is possible to release the lining rollers when the reference system indicates that no lining correction is required, thus enabling the position of the lining rollers to be reset from time to time to adapt it to changing track gages. In any event, it is essential that the lining rollers are in play-free engagement with the rails before a lining operation begins.

To enable the lining rollers to be pressed against the associated rail without play, it is necessary to deliver the hydraulic fluid by pump 23 into line 21 under a suitably high pressure. This pressure will be so selected that the flange of the lining roller will press against the inside of the rail head without deforming the rail and possibly damaging the rail fastening elements which affix the rail to the ties, particularly at rail crossings. For instance, experience has shown that a pressure of about 3 to 5 atmospheres will assure play-free engagement of the lining rollers with the rail head without outwardly pivoting the rail or loosening spikes affixing the rail to the ties. Those skilled in the art will be readily able to adjust this pressure to specific track conditions.

The illustrated control includes a further control switch 26 for operation of valve 20, enabling the operator readily to adapt lifting and lining unit 8 to any gage when the unit is lowered onto the track. Furthermore, switch 26 enables the operator manually to lock the lining rollers in any position and/or to move them together or apart for adaptation to a given track gage. This is facilitated by the provision of track gage indicator 30 comprising a pointer cooperating with a scale. The scale is affixed to frame 9 while the pointer is carried by the piston rod of adjustment drive 17 so that the distance between the lining rollers, and the track gage indicated thereby, can always be visually determined by reading the position of the pointer on the scale. Thus, for a given track gage, the rollers may be moved together or spread apart until the indicator shows the track gage. Obviously, this visual track gage indicator may be replaced by any suitable mechanical or electromechanical indicating means, any suitable transducer and indicator and/or recording instruments being mounted on the operator's console to communicate the track gage to the operator.

Track gage indicators will be of particular use in track sections where the rail fasteners are relatively loose because they will permit a more thorough control of the lining roller movements to given track gages.

FIG. 3 shows that, if desired, conduit 27 leading to adjustment drive 17 may be in direct connection with hydraulic fluid delivery line 21 by means of branch line 31, check valve 39 being mounted in the branch line to permit only unidirectional flow of hydraulic fluid from line 21 into line 27 to exert transverse pressure upon the lining rollers but preventing back-flow of the fluid. In this case, actuation of valve 20 by switch 25 is unnecessary since hydraulic pressure is constantly exerted upon the piston in drive 17 so that the lining rollers are permanently pressed against the rail heads. During the lining operation, when lifting and lining unit frame 9 is moved to the right by motor 19, as seen in FIG. 3, lining rollers 10 associated with the right rail tend to move the piston of drive 17 leftwards, i.e., in a direction opposite to that of the pressure exerted by the hydraulic fluid flowing through lines 21, 31 and 27 into the cylinder chamber remote from the rollers. However, no such leftward movement is possible because, when valve 20 is used, the same is in the rest position and prevents fluid outflow, and when by-pass line 31 is used, check valve 39 will similarly prevent such fluid outflow, thus locking the piston and the rollers in position. When the by-pass line and check valve are used, it is essential to use three-way valve 29 so that conduit 28 is always in communication with return line 22. The three-way valve makes it possible to direct hydraulic fluid from delivery line 21 through valve 20 into conduit 28 leading to drive 17 and to direct the fluid back to sump 35. In this way, it is unnecessary to control valve 20 at the time the tamping unit is lowered into the ballast.

FIG. 2*a* shows a modified lining roller arrangement, the lifting hook and other arrangements having been omitted from this figure for the sake of clarity, these arrangements being identical with FIG. 2. In this modified embodiment of the lifting and lining unit, the lining rollers have a pair of flanges 10*a*, 10*a* arranged to hold the rail head of the associated rails therebetween. In this case, it will be useful to provide adjustment drives 17 for the lining rollers associated with both rails, i.e., to mount both pairs of rollers 10, 10 for lateral movement on frame 9. Thus, respective flanges of the rollers may be pressed into play-free engagement with respective sides of the rail heads, depending on the direction of lining correction indicated by reference system 5. For instance, if the track is to be moved to the right, as seen in the operating direction in FIG. 2*a*, the lining rollers associated with the lower rail seen in this figure would be pressed against the inside of the rail head while the rollers associated with the upper rail would be pressed against the outside of the rail head. Thus, play-free engagement of all lining rollers during the correction operation is assured whether the rollers are single- or double-flanged.

As is well known in the art of track maintenance and correction, the control of leveling and lining drives 18 and 19 is determined by reference systems 5 and 6, which forms no part of the present invention. In the illustrated and preferred embodiment, the reference systems are carried on the long machine frame, and the tamping as well as the leveling and lining units are mounted between the undercarriages of the machine. With all the drives for operation of the units hydraulically operated, it will be easy to coordinate their functioning in the desired sequence for effectuating tamping, lifting and lining, and locking of the lining rollers into their positions in play-free engagement with the rails.

FIG. 4 shows a specific embodiment of a rail lifting hook useful in the lifting and lining unit of this invention. Modified hook 32 has a stepped hoop portion for selectively engaging or subtending the rail head of rail 3 or a projecting portion of fishplate 33. This stepped configuration of the hook portion makes it possible to use the rail lifting hook at such points simply by moving the hook transversely to the direction of track elongation and parallel to the track plane without moving the hook vertically to the track plane. Such a hook may be used very advantageously at all track points, even in the presence of a fishplate, by simply moving guide rods 13 carrying the hooks outwardly at the end of a tamping operation so as to disengage the hooks from the rails as the machine advances to the next correction point, and then moving the guide rods and hooks towards each other at this point, when the machine is stopped, to permit the hook portions to subtend the rail head or fishplate, thereby gripping the track rails for lifting.

Depending on the vertical position of the hook, the hook portion thereof may subtend not only the rail head but also the base of the rail. If the hook is incapable of gripping any part of the rail or fishplate, lifting and leveling unit 8 may be moved in the direction of track elongation by hydraulic drives 34 whose piston rods are linked to frame 9, for instance by means of rubber couplings, while their cylinders are mounted on machine frame 1 so that frame 9 may be moved in relation to frame 1 into such a position that the hooks will find a track point where they can grip the rails.

The above-described control for a track lining and leveling unit may be used not only on track tamping, leveling and lining machines, as herein specifically described and illustrated, but also on track liners or track tampers, as well as ballast cleaning machines or machines for fastening the track rails to the ties. The track lining and leveling unit of this invention is particularly useful in track leveling and lining machines which can also be used to tamp ties in the region of track crossings and switches because of the multiple ways of moving the rail lifting hooks and the entire unit while always maintaining play-free engagement of the lining rollers with the rails without subjecting the sensitive rail portions at such track points to undue pressures.

While the invention has been described in conjunction with certain now preferred embodiments, it will be clearly understood that many variations and modifications, particularly of the control circuitry and the nature of the drives, may occur to those skilled in the art without departing from the spirit and scope of the present invention as defined in the appended claims.

What is claimed is:

1. In a mobile apparatus for working on a track including two rails fastened to ties, which comprises a track lining and leveling unit having a frame mounted for mobility on the track rails, hydraulic drive means for moving the frame in mutually perpendicular directions extending transversely and vertically to the track for lining and leveling the track, flanged lining rollers mounted on the frame for engagement with an associated one of the rails, and poweractuated rail lifting hooks mounted on the frame and arranged to subtend the rails, the improvement of 1. adjustment drive means for continuously and simultaneously moving the lining rollers into substantially play-free engagement with the associated rails, and
2. a control for the adjustment drive means for temporarily holding the lining rollers in a fixed relation to the frame.

2. In the mobile track working apparatus of claim 1, wherein the adjustment drive means is pressure fluid-actuated and the control comprises valve means controlling the pressure fluid actuation.

3. In the mobile track working apparatus of claim 2, wherein the pressure fluid-actuated adjustment drive means is a hydraulic drive comprising a cylinder housing a piston dividing the cylinder into two chambers, and two conduits respectively connected to the cylinder chambers, the two conduits being connected to the control valve means.

4. In the mobile track working apparatus of claim 1, further comprising a track gage indicator means associated with the adjustment drive means for presetting the lining rollers at a desired gage.

5. In the mobile track working apparatus of claim 1, wherein two of said flanged lining rollers are associated with each of the rails, the two rollers being spaced from each other in the direction of track elongation, and further comprising a crossbeam interconnecting the two rollers, the adjustment drive means being connected to the crossbeam.

6. In the mobile track working apparatus of claim 5, wherein the spacing between the two rollers is substantially the same as that between adjacent ones of the track ties.

7. In the mobile track working apparatus of claim 5, wherein the rail lifting hooks are arranged intermediate the two lining rollers associated with each rail.

8. In the mobile track working apparatus of claim 1, further comprising a machine frame mounted on two undercarriages for mobility on the track and reference systems carried on the machine frame for controlling the leveling and lining of the track, the track lining and leveling unit frame being mounted on the machine frame between the two undercarriages, and the hydraulic drive means being arranged to move the frame of the track lining and leveling unit in relation to the machine frame.

9. In the mobile track working apparatus of claim 1, wherein the lining rollers are double-flanged.

10. In a mobile apparatus for working on a track including two rails fastened to ties, which comprises a track lining and leveling unit having a frame mounted for mobility on the track rails, hydraulic drive means for moving the frame in mutually perpendicular directions extending transversely and vertically to the track for lining and leveling the track, flanged lining rollers mounted on the frame for engagement with an associated one of the rails, and power-actuated rail lifting hooks mounted on the frame and arranged to subtend the rails, the improvement of 1. a hydraulic adjustment drive for continuously and simultaneously moving the lining rollers into substantially play-free engagement with the associated rails, the drive comprising
   a. a cylinder housing a piston dividing the cylinder into two chambers, and
   b. two conduits respectively connected to the cylinder chambers; and
2. a control for the adjustment drive for temporarily holding the lining rollers in a fixed relation to the frame, the control comprising
   a. a source of hydraulic fluid,
   b. a hydraulic fluid delivery line leading from the fluid source and a hydraulic fluid return line leading to the fluid source, and
   c. a valve means controlling the pressure fluid actuation, the two conduits of the adjustment drive being connected to the control valve means, and the valve means comprising an adjustable valve and check valve means, the adjustable valve being arranged for selective connection of one of the conduits to the hydraulic fluid delivery line and of the other conduit to the hydraulic fluid return line, and the check valve means being arranged to prevent hydraulic fluid flow from the cylinder chamber receiving hydraulic fluid from the delivery line.

11. In a mobile apparatus for working on a track including two rails fastened to ties, which comprises a track lining and leveling unit having a frame mounted for mobility on the track rails, hydraulic drive means for moving the frame in mutually perpendicular directions extending transversely and vertically to the track for lining and leveling the track, flanged lining rollers mounted on the frame for engagement with an associated one of the rails, and power-actuated rail lifting hooks mounted on the frame and arranged to subtend the rails, the improvement of 1. adjustment drive means for continuously and simultaneously moving the lining rollers into substantially play-free engagement with the associated rails,
2. a control for the adjustment drive means for temporarily holding the lining rollers in a fixed relation to the frame, and
3. the lifting hooks having a stepped hook portion for selective engagement with the rail head and another, lower rail part.

12. In a mobile apparatus for working on a track including two rails fastened to ties, which comprises a track lining and leveling unit having a frame mounted for mobility on the track rails, hydraulic drive means for moving the frame in mutually perpendicular directions extending transversely and vertically to the track for lining and leveling the track, flanged lining rollers mounted on the frame for engagement with an associated one of the rails, and power-actuated rail lifting hooks mounted on the frame and arranged to subtend the rails, the improvement of 1. a hydraulic adjustment drive for continuously and simultaneously moving the lining rollers into substantially play-free engagement with the associated rails, the drive comprising
   a. a cylinder housing a piston dividing the cylinder into two chambers, and
   b. two conduits respectively connected to the cylinder chambers; and
2. a control for the adjustment drive for temporarily holding the lining rollers in a fixed relation to the frame, the control comprising
   a. a source of hydraulic fluid,
   b. a hydraulic fluid delivery line leading from the fluid source and a hydraulic fluid return line to the fluid source, c. pump means for delivering hydraulic fluid under pressure from the hydraulic fluid source into the delivery line, d. a branch line connecting one of the conduits to the delivery line, e. a check valve in the branch line preventing back-flow of hydraulic fluid to the delivery line from the cylinder chamber connected to the branch line, f. another branch line connecting the other conduit to the return line, and g. a multi-way valve in the other branch line.

* * * * *